United States Patent [19]

Stahlhut et al.

[11] 4,356,537

[45] Oct. 26, 1982

[54] LIGHTING FIXTURE RETAINER HOOK

[75] Inventors: Leo G. Stahlhut, Kirkwood, Mo.; Willard R. Garnett, Tupelo; Lewis W. Kenyon, Baldwyn, both of Miss.

[73] Assignee: Emerson Electric Co., St. Louis, Mo.

[21] Appl. No.: 178,472

[22] Filed: Aug. 15, 1980

[51] Int. Cl.[3] ..... F21S 1/02

[52] U.S. Cl. ..... 362/148; 362/217; 362/223; 362/224; 362/225; 362/249; 362/365; 362/396

[58] Field of Search ..... 362/148, 217, 223, 224, 362/225, 249, 365, 396

[56] References Cited

U.S. PATENT DOCUMENTS 4,086,480 4/1978 Lahm ..... 362/148

*Primary Examiner*—Stephen J. Lechert, Jr.

*Attorney, Agent, or Firm*—Polster, Polster and Lucchesi

[57] ABSTRACT

In a recessed lighting fixture intended to be laid onto horizontal flanges of inverted T-shaped rails of a grid-type ceiling, the rails having a stem with a bulb defining shoulders below the upper edge of the stem, the fixture having a housing with metal end plates, a hook is formed integrally with one of the end plates. The hook extends across and embraces the bulb. The hook is either formed with a nose projecting in a direction toward the end plate and beneath a shoulder defined by the bulb, or a tab, integral with the end plate, is provided that has a free upper edge projecting from the end plate toward and beneath a shoulder facing the end plate.

5 Claims, 4 Drawing Figures

BEFORE BENDING

AFTER 90° BEND

LIGHTING FIXTURE RETAINER HOOK

BACKGROUND OF THE INVENTION

This invention relates to recessed lighting fixtures adapted to be mounted by laying them on flanges of inverted T-shaped rails forming a part of a grid-type ceiling. Such fixtures consist essentially of an open-bottomed metal box (housing) in which fluorescent tubes are mounted, and a light-transmitting lens or enclosure mounted in the housing to close the open bottom. It is a requirement of the National Electrical Code that some means be provided to inhibit the fixture's falling in case the T-rails spread or the fixture accidentally is shifted laterally with respect to the flange or flanges on which it is resting. Conventionally, this requirement is met by attaching grid clips, in the field, to the outside of the end of the fixture. This entails supplying clips to a job site and a workman's carrying a supply of clips.

One of the objects of this invention is to eliminate the need for separate grid clips.

Other objects will become apparent to those skilled in the art in the light of the following description and accompanying drawing.

SUMMARY OF THE INVENTION

In accordance with this invention, generally stated, in a recessed lighting fixture adapted to be laid onto horizontal flanges of inverted T-shaped rails of a grid-type ceiling, the rails having a stem with a bulb defining shoulders below the upper edge of the stem, the fixture having a housing with metal end plates, a hook is formed integrally with one of the end plates and adapted to extend across and to embrace the bulb, and means are provided, integral with the end plate, for projecting beneath one of the shoulders. In the preferred embodiment, the means for projecting beneath one of the shoulders is a tab formed in the end plate integrally with the plate and of a piece with the plate along a lower edge of the tab and adapted to be bent out along its lower edge from the end plate, with its upper edge projecting beneath a shoulder facing the end plate. Preferably, the tab is positioned between and laterally spaced from two of the hooks, and is provided with a screwdriver-blade receiving slot. In another embodiment, the means for projecting beneath one of the shoulders is a nose integral with the hook and projecting, when the hook is in bulb-embracing position, toward the end plate.

DESCRIPTION OF THE PREFERRED EMBODIMENT

Figure 1:
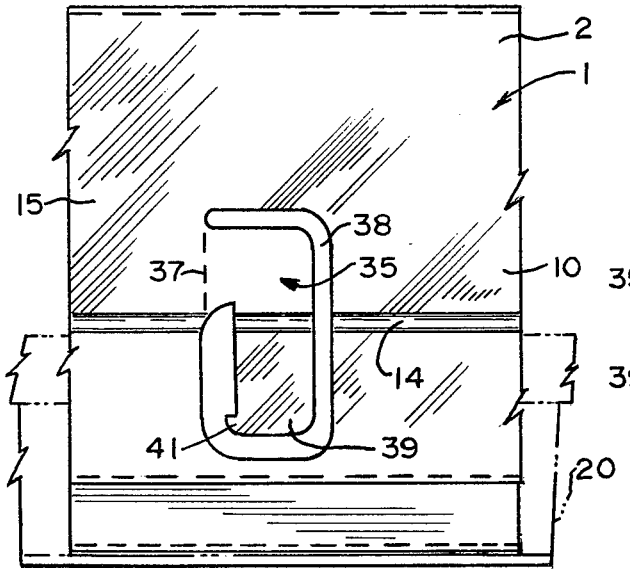
FIG. 1 is a fragmentary view in end elevation of a fixture illustrating one embodiment of this invention.

Referring now to the drawing for illustrative embodiments of this invention, reference numeral 1 indicates a lighting fixture having a housing 2 and a lens or enclosure 3. The housing 2 is rectangular in plan with side walls 5 and end plates or walls 10. In the illustrative embodiment shown, the end plates have an offset in them with an upper end plate section 15 parallel with but outboard of a lower section 17, and a bridging web 14 between them.

The fixture rests upon and is supported by T-rails 20 forming part of a ceiling grid. Each of the T-rails has flanges 22 and 23, and a stem 25 with a bulb or head 27 integral with and extending along the stem 25 and defining stem shoulders 29 and 30. Lower edges of the end plates 10 rest upon flange 22 at one end of the fixture, as shown, and upon a flange 23 at the other end of the fixture.

Figure 2:
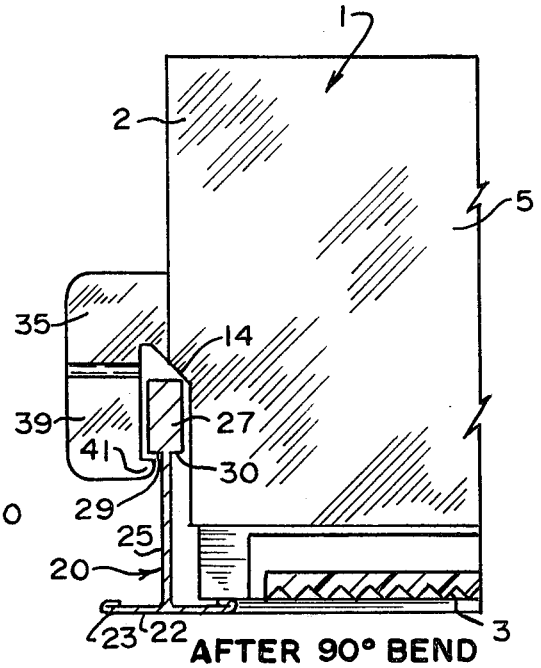
FIG. 2 is a fragmentary view in side elevation, partly in section, of the device of FIG. 1.

In the embodiment of this invention shown in FIGS. 1 and 2, a hook 35 is formed integrally with the end plate 10. The hook 35 is of a piece with the upper section 15 of the end plate along a hinge line 37. A space 38 around the rest of the hook 35 is blanked out from the end plate. The hook 35 of this embodiment has a leg 39 from which a nose 41 projects. When the hook 35 is bent, along the hinge line 37, to a position at 90 degrees from the end plate, as shown in FIG. 2, the nose 41 projects toward the end plate 10 and beneath the shoulder 29 remote from the end plate.

It will be seen that the hook is so proportioned and arranged that the leg 39 extends over and embraces the bulb 27 closely enough to ensure that the outer end surface of the end plate can not clear the contiguous edge of the flange 22. The span of the fixture between parallel rails is such that the nose 29 of hooks on opposite ends of the fixture will not clear both shoulders at once.

Figure 3:
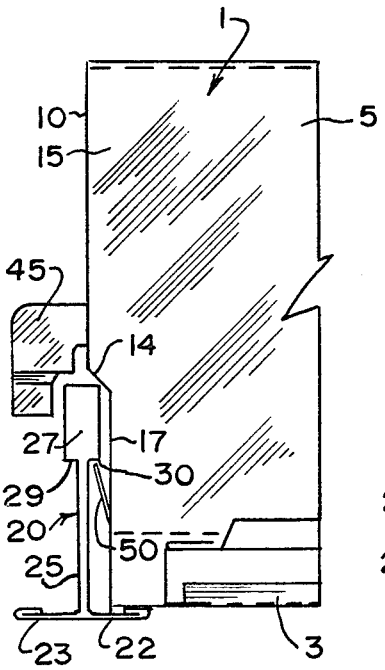
FIG. 3 is a fragmentary view in side elevation of the preferred embodiment of this invention.
Figure 4:
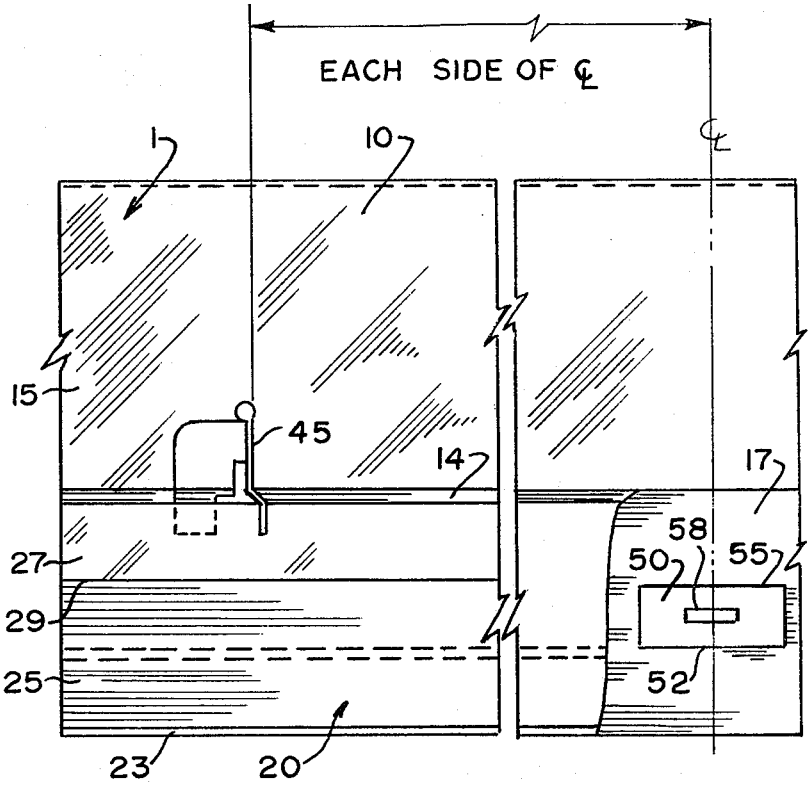
FIG. 4 is a view in end elevation, partly cut away, of the device shown in FIG. 3.

In the embodiment shown in FIGS. 3 and 4, which is the preferred embodiment, a hook 45 is, like the hook 35, made integral with the end plate 10, and of a piece along a hinge line with the upper section 15. The hook 45 has no nose. However, a tab 50, integral with the end plate 10 along a hinge line 52 is defined by a cut line 55, and is bent out from the end plate along the hinge line 52 so that a free edge of the tab extends beneath a shoulder 30 of the rail 20. Preferably, as indicated in FIG. 4, two hooks 45 are provided, spaced symmetrically about the center line of the end plate, and the tab 50 is positioned on and extending symmetrically to either side of the center line between the tabs 45. The tab 50 is provided with a screwdriver-blade slot 58. The slot 58 is useful in bending the tab outwardly, but is particularly useful in bending the tab back toward the end plate when the fixture is to be demounted.

As shown clearly in FIG. 3, the use of the tab 50 provides positive inhibition of the fixture from upward movement with respect to the rail 20.

Numerous variations in the construction of the device of this invention within the scope of the appended claims will occur to those skilled in the art in the light of the foregoing disclosure. Merely by way of example, the shape of the hooks can be varied. A hook with a nose can be employed with a tab, in a combination of the two embodiments shown, although one upward movement inhibiting means has been found to be generally sufficient. Screwdriver-blade slots can be provided in the legs of the hooks to facilitate their being bent out, although in the embodiments shown, the space 38 is sufficient to permit the hooks to be bent enough by hand or with a prizing tool such as a screwdriver to admit of their being grasped by a pair of pliers and bend along the hinge line. A single hook 45 can be positioned on the center line, and tabs 50 spaced to either side, although the provision of two hooks is the preferred arrangement. Preferably two hooks are provided at each end of the fixture, but other numbers of hooks or other mounting means at one end can be employed. It is not necessary that the T-rails be a simple T shape, as long as they have flanges and shoulders (cf. Stahlhut U.S. Pat. No. 3,279,139). These variations are merely illustrative.

We claim:

1. In a recessed lighting fixture adapted to be laid onto horizontal flanges of inverted T-shaped rails of a grid-type ceiling, said rails having a stem with a bulb defining shoulders below the upper edge of said stem, said fixture having a housing with metal end plates, the improvement comprising a hook formed integrally with and intermediate the span of a planar section of one of said end plates and adapted to project at substantially right angles to the said planar section and to extend across and embrace said bulb, and means integral with said end plate for projecting beneath one of said shoulders wholly on one side of said stem.

2. The improvement of claim 1 wherein the means for projecting beneath one of said shoulders is a nose integral with said hook and projecting, when said hook is in bulb embracing position, toward said end plate.

3. The improvement of claim 1 wherein the means for projecting beneath one of said shoulders is a tab formed in said end plate and integral with said plate along a lower edge of said tab and adapted to be bent out along said lower edge from said end plate with its upper edge projecting beneath a shoulder facing said end plate.

4. The improvement of claim 3 wherein said tab is positioned between and laterally spaced from two of said hooks.

5. The improvement of claim 3 wherein the tab is provided with a screwdriver blade-receiving slot whereby the tab can be bent from the end plate to its position to project beneath said shoulder and bent back from beneath the shoulder for release of said fixture.

* * * * *